United States Patent [19]

Warburton

[11] Patent Number: 4,605,819

[45] Date of Patent: Aug. 12, 1986

[54] CONDUCTOR FOR HIGH VOLTAGE ELECTRICITY

[76] Inventor: Frank W. Warburton, 2 Warburton La., Westboro, Mass. 01581

[21] Appl. No.: 656,491

[22] Filed: Oct. 1, 1984

[51] Int. Cl.[4] ..... H01B 5/08

[52] U.S. Cl. ..... 174/127; 174/128 R; 174/129 R

[58] Field of Search ..... 174/127, 128 R, 129 R, 174/130

[56] References Cited

U.S. PATENT DOCUMENTS

| | | | |
|---|---|---|---|
| 1,626,777 | 5/1927 | Austin | 174/127 |
| 1,999,502 | 4/1935 | Hall | 174/129 R |
| 2,022,839 | 12/1935 | Austin | 174/127 |
| 2,162,130 | 6/1939 | Somerville | 174/128 R |

OTHER PUBLICATIONS

Comber, M. G. et al; Audible-Noise Reduction by Bundle Geometry Optimization; Paper for presentation IEEE PES Winter Meeting; New York, N.Y., Jan.-/Feb. 1973.

*Primary Examiner*—A. T. Grimley
*Assistant Examiner*—Morris H. Nimmo
*Attorney, Agent, or Firm*—Blodgett & Blodgett

[57] ABSTRACT

A conductor for high voltage of electricity, comprising a plurality of circular conductor wires which are wound helically to form a circular cable and a protrusion wire which is helically wound with the conductor wires as part of the cable in the outer periphery of the cable, so as to protrude beyond the outer periphery of the cable.

3 Claims, 6 Drawing Figures

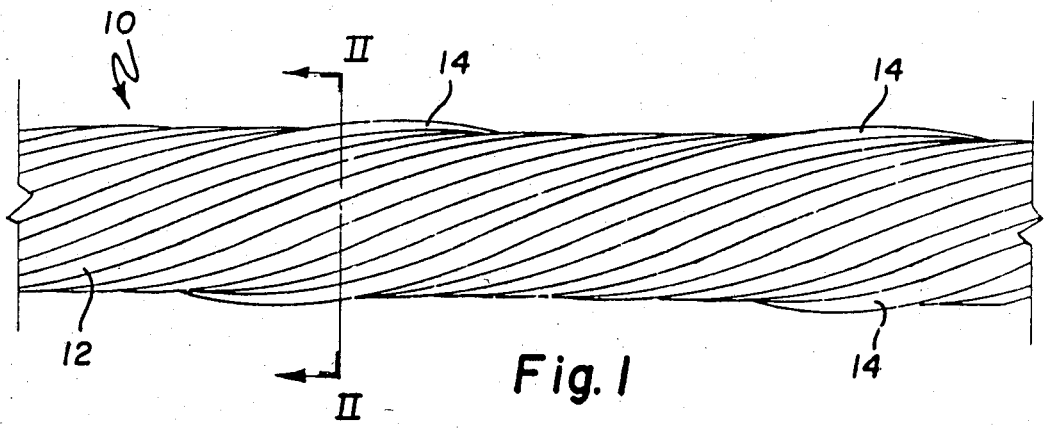
Fig. 1
Fig. 2
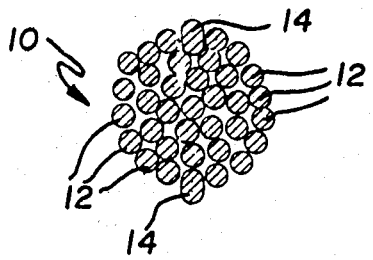
Fig. 3
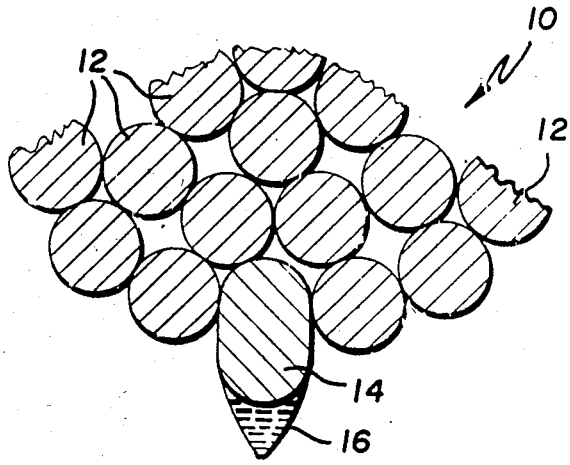
PRIOR ART
Fig. 4
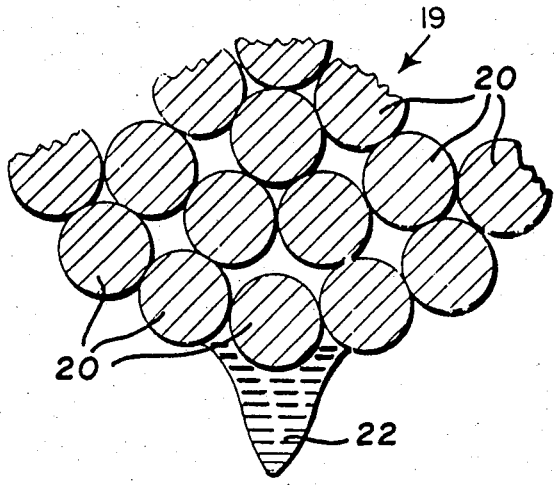

CONDUCTOR FOR HIGH VOLTAGE ELECTRICITY

BACKGROUND OF THE INVENTION

The present invention relates to an improved conductor for high voltage transmission line, for example, 230 kV or more. In the present day, the typical high voltage conductor comprises a plurality of conductor wires which are wound helically in a cable. Due to the high voltage, a high electric field is created and directed outward from the conductor surface. Under certain conditions, this leads to the formation of coronas which represents a substantial loss in energy. In addition to the loss of energy, the development of the coronas creates environmental pollution in the form of television and radio interference and objectionable audible noise in the near vicinity of the transmission line. The problem of corona development has been solved to some degree by the substitution of multlple small conductors for the single large conductor.

During periods of above-freezing precipitation, water collects on the top and sides of the conductor and rolls or slides downward to the bottom of the conductor. Eventually, drops of water form all along the bottom of the conductor. Each water drop represents a protrusion from tha outer surface of the conductor. Practically all water drops concentrate the electric field at the drop tip to a degree that exceeds the safety factor which is built into the conductor and coronas develop. For the typical 60 cycle transmission line, the coronas generated on parts of the positive half cycle, 1/120 second duration, are burst pulses, onset streamers, and plume streamers. Trichel pulses occur on the negative half cycle. The plume streamer is the most intense corona and represents the greatest energy loss as well as the most troublesome radio and audible noises from the conductor. Positive and negative coronas are considered to also cause conductor vibration.

In the applicant's considered opinion, coronas and, in particular, plume streamers are the result of three major factors which are in order of importance: the distance out from the conductor to about 4 kV/cm field strength, the protrusion coefficient, and the conductor surface gradient. To a certain strength, the electric field of the conductor sharpens the tip of the drop, thereby intensifying the electric field leaving the tip. With increasing half-cycle voltage a very small particle spray develops. With more voltage corona and spray occurs. Since the bottom water drops flow down the conductor catenary slopes, the highest incident of coronas is on the lower height section of the catenary.

Although the problem of precipitation induced coronas for high voltage conductors has long been recognized, no effective means have been developed for eliminating the problem. One attempt to solve this problem, consists of the application of stalactite-like projections along the bottom of a conductor to collect and discharge water. The projections cannot be applied to the conductor during manufacture of the conductor, since it would interfere with winding of the conductor on the spool so that it would be impractical to store and transport the conductor. Application of the projections after the conductor has been installed is also very difficult and impractical. In addition, the projections would be affected by wind and might initiate vibration of the conductor.

These and other difficulties experienced with the prior art devices have been greatly decreased by the present invention.

It is, therefore, a principle object of the invention to provide a high voltage conductor which is effective in reducing coronas during periods of above-freezing precipitation.

Another object of the invention is the provision of a high voltage conductor which is effective for reducing coronas in moderate and higher rainfalls by shedding water with minor corona generation.

A further object of the present lnvention is the provision of a high voltage conductor which is effective in reducing the negative effects of coronas by reducing their intensities.

It is another object of the present invention to provide a high voltage multi-wire conductor which is effective in reducing coronas during periods of above-freezing precipitation and which can be formed by conventional conductor fabricating apparatus.

A still further object of the invention is the provision of a multi-strand high voltage conductor which is effective in reducing coronas during periods of above-freezing precipitation and which can be stored and transported on conventional spools or reels.

It is a further object of the invention to provide a multi-wire high voltage conductor which is effective in reducing coronas during periods of above-freezing precipitation by employing a protrusion element which is part of the conductor.

It is a further object of the invention to provide a high voltage conductor which is effective in reducing coronas during periods of above-freezing precipitation and which is simple in construction, inexpensive to manufacture, and capable of a long life of useful service.

With these and other objects in view, as will be apparent to those skilled in the art, the invention resides in the combination of parts set forth in the specification and covered by the claims appended hereto.

SUMMARY OF THE INVENTION

In general, the invention consists of a conductor for high voltage transmission line, comprising a plurality of circular conductor wires which are wound helically to form a generally circular cable and a protrusion wire which is helically wound with the conductor wires to constitute part of the cable and protrudes beyond the outer periphery of the cable. More specifically, the protrusion wire is elongated and is made of an electrically conductive material.

The advantages of the invention are: the shedding of conductor collected water in moderate to heavy precipitation, thus eliminating major coronas; and by reducing corona intensities in light precipitation.

BRIEF DESCRIPTION OF THE DRAWINGS

The character of the invention, however, may be best understood by reference to one of its structural forms, as illustrated by the accompanying drawings, in which:

FIG. 1 is a fragmentary elevational view of a section of high voltage conductor embodying the principles of the present invention, FIG. 2 is a vertical cross-sectional view of the conductor taken on the line II—II of FIG. 1, FIG. 3 is a fragmentary enlarged cross-sectional view of the bottom portion of the conductor, FIG. 4 is a view similar to FIG. 3 showing a prior art conductor.

DESCRIPTION OF THE PREFERRED EMBODIMENT

Figure 5:
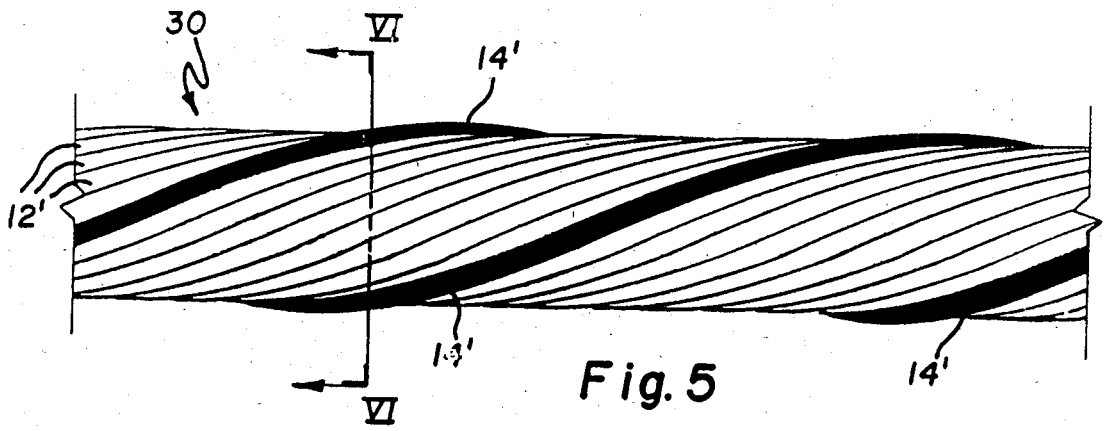
FIG. 5 is a view similar to FIG. 1 showing a modified conductor.

Referring first to FIGS. 1 and 2, the conductor of the present invention is generally indicated by the reference numeral 10 and comprises a plurality of circular conductor wires 12 which are helically wound to form a circular cable as shown in FIG. 2. The conductor 10 also includes one or more protrusion wires 14 located within the circle which is formed by the outer peripheral wires 12. Each protrusion wire 14 of the preferred embodiment is elongated in cross-section and constructed of a conductive material so that it forms an integral part of the conductor cable. The cross-sectional width of the protrusion wire 14 is approximately equal to the diameter of each conductor wire 12, so that it occupies the same space in the outer circle of conductor wires as though it were circular in cross-section. However, the elongated cross-sectional shape of the protrusion wire 14 causes it to protrude beyond the outer radius of the conductor 10, as shown in FIGS. 2 and 3.

The operation and advantages of the present invention will now be readily understood in view of the above description. During periods of above-freezing precipitation, which includes everything from fog to a downpour, water accumulates on all parts of the conductor 10 and eventually flows to the bottom of the conductor. Protrusion wires 14 function as guide channels for directing most of the water to the bottom of the protrusion wires and prevents the water from flowing past the protrusion wires. The water eventually forms a drop at the bottom of the strand 14, such as the drop 16 shown in FIG. 3. Since the protrusion wire 14 extends beyond the adjacent conductor wires 12, the drop of water 16 which forms on the protrusion strand 14 is considerably smaller than the drop which normally forms on a conventional conductor which is made up entirely of circular conductor wires such as that shown in FIG. 4. The conventional conductor shown in FIG. 4 is generally indicated by the reference 19 and comprises a plurality of circular conductor wires 20 arranged in a circular cable. During periods of precipitation, drops form on the bottom of the conductor, such as that indicated by the reference numeral 22. Water drop 22 extends from three or more conductor wires depending on the size of the conductor and of the individual wires, so that a much larger drop is formed. The maximum size of drop 22 before spilling is considerably greater than the maximum size of drop 16 which forms at the bottom of the protrusion wire 14 in terms of length, width of base and overall volume. These factors contribute to the gathering of the electrical field which surrounds the conductor, concentrating this field to the tip of the drop to form coronas. The coronas thus formed on drop 22 are substantially greater in the size and intensity than the coronas which are formed on drop 16. Since drop size is limited by the protrusion wire 14, much more water is shed or spilled before becoming involved in the formation of coronas except for retrograde streamers which are of minor consequence. This is particularly true during heavier precipitation. The degree of protrusion of the wire 14 relative to the conductor wires 12 should be well below the corona threshold point. Since the protrusion wire limits drop size, less corona is formed during periods of precipitation. This represents a saving in power, less conductor vibration and less television and radio interferences.

MODIFICATION

Figure 6:
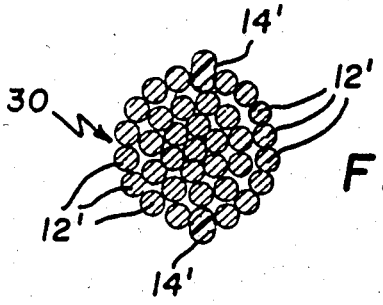
FIG. 6 is a vertical cross-sectional view of the modified conductor taken on the line VI—VI of FIG. 5.

Referring to FIGS. 5 and 6, the modified conductor is generally indicated by the reference numeral 30 and comprises a plurality of circular conductor wires 12′ which are wound generally in a circular cable. The conductor 30 also includes one or more protrusion strands 14′ in the outer circular group of conductor wires 12′, as shown in FIG. 6. The construction of the conductor 30 is identical to the conductor 10 of the preferred embodiment, except that each protrusion strand 14′ is made of a low dielectric constant and high electrical resistance material, such as plastic. Although the protrusion strands 14′ are structurally part of the conductor 30, they are not functionally part of the conductor since they are not involved in transmission of electricity. This represents a reduction in the effective cross-section of the conductor 30, thereby reducing its conductive efficiency in terms of cable weight. However, since the protrusion strands 14′ is made of a low dielectric high resistance material, it reduces the electric field, and therefore, supports less corona. The electric field is then mostly limited to the small cross-sectional area of the water films supplying the water drop. Since the embodiment shown in FIGS. 5 and 6 is more effective in reducing corona, the savings in power loss more than compensate for its inefficiency in transmitting electricity, particularly in localities having above normal precipitation. It is preferred that the surface of the protrusion wire 14 be hydrophilic. Also, it is preferred that the strands 14′ be made of a material which is resistant to burning by coronas.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Conductor for high voltage electricity comprising:
(a) a plurality of circular conductor wires which are wound helically to form a gernerally circular cable, said cable including an outermost annular layer, and
(b) a protrusion wire which forms part of said outermost annular layer and which extends helically along said cable with the wires of said outermost layer, a portion of, said protrusion wire protruding outwardly beyond the outer periphery of said cable, said protrusion wire being elongated in cross-section and having a major dimension which extends along a radial line which extends from the center of said cable and a minor dimension which is substantially equal to the diameter of said conductor wires, the dimension of said protrusion wire in a direction which is normal to said radial line being no greater that said minor dimension at any point along said radial line.

2. Conductor as recited in claim 1, wherein said protrusion wire is made entirely of an electrically conductive material.

3. Conductor for high voltage electricity comprising:

(a) a plurality of circular conductor wires which are wound helically to form a generally circular cable, said cable including an outermost annular layer, and (b) a protrusion strand which forms part of said outermost annular layer and which extends helically along said cable, said protrusion strand protruding outwardly beyond the outer periphery of said cable, said protrusion strand being made entirely of a material having a low dielectric constant and high electrical resistence.

* * * * *